United States Patent [19]

Macier et al.

[11] Patent Number: 4,870,929

[45] Date of Patent: Oct. 3, 1989

[54] MULTI-CYLINDER ENGINE WITH UNIFORM CYLINDER SENSITIVITY TO KNOCKING

[75] Inventors: James E. Macier, Beach Park; Gregory J. Binversie; David C. Calamia, both of Grayslake; John M. Daniels, Round Lake Park, all of Ill.

[73] Assignee: Outboard Marine Corporation, Waukegan, Ill.

[21] Appl. No.: 215,575

[22] Filed: Jul. 6, 1988

[51] Int. Cl.[4] ..... F02B 75/04

[52] U.S. Cl. ..... 123/78 R; 123/193 H

[58] Field of Search ..... 123/193 H, 48 D, 48 R, 123/78 R

[56] References Cited

U.S. PATENT DOCUMENTS

| | | | |
|---|---|---|---|
| 3,961,607 | 6/1976 | Brems | 123/53 R |
| 4,174,683 | 11/1979 | Vivian | 123/48 C |
| 4,286,552 | 9/1981 | Tsutsumi | 123/48 B |
| 4,499,872 | 2/1985 | Ward et al. | 123/90.18 |
| 4,501,236 | 2/1985 | Fletcher | 123/48 R |

*Primary Examiner*—David A. Okonsky

*Attorney, Agent, or Firm*—Michael, Best & Friedrich

[57] ABSTRACT

Disclosed herein is an internal combustion engine comprising first and second cylinders and first and second cylinder head cavities respectively aligned and communicating with said first and second cylinders to respectively define compression ratios respectively associated with each of said first and second cylinders, and means for providing each of said first and second cylinders with respectively different compression ratios selected to maximized the power produced in each cylinder without knocking.

3 Claims, 1 Drawing Sheet

MULTI-CYLINDER ENGINE WITH UNIFORM CYLINDER SENSITIVITY TO KNOCKING

BACKGROUND OF THE INVENTION

The invention relates generally to multi-cylinder internal combustion engines of both the two stroke and the four stroke type.

The invention also relates generally to prevention of "knocking" and to maximization of engine power.

It is known that cylinder knocking diminishes effective power output and is related to a variety of factors including the cylinder compression ratio, ignition timing or degree or amount of spark advance, the type of fuel, the cylinder operating temperature and the quantities of fuel and air present in the cylinder.

The cylinder temperature is, in part, a function of the engine cooling system, and the quantity of fuel and air present in the cylinder are determined by the air supply, fuel supply, and exhaust discharge systems.

In many prior multi-cylinder engines, the cylinders each had the same compression ratio and the particular characteristics of the cooling, air, fuel, and exhaust discharge systems caused knocking to occur at differing times for different cylinders. Engines were usually designed to avoid knocking in the most sensitive cylinder, thereby also avoiding knocking in the other cylinders.

In the past, attempts have been made to operate engines with a different spark advance for each cylinder to maximize power by avoiding knocking. However, such efforts cause difficulties in providing smooth, low speed running characteristics.

SUMMARY OF THE INVENTION

The invention provides an internal combustion engine comprising first and second cylinders and first and second cylinder head cavities respectively aligned and communicating with the first and second cylinders to respectively define compression ratios respectively associated with each of said first and second cylinders, and means for providing each of said first and second cylinders with a different non variable compression ratio selected to maximize the power produced in each cylinder without knocking.

The invention also provides an internal combustion engine comprising first and second cylinders and first and second cylinder head cavities respectively aligned and communicating with the first and second cylinders to respectively define compression ratios respectively associated with each of the first and second cylinders, and means for providing each of the first and second cylinders with substantially the same sensitivity to knocking, which means comprise respective fixed and pre-selected differences in size of the first and second cylinder head cavities.

Various other features and advantages of the invention will become apparent to those skilled in the art upon review of the following detailed description, claims, and drawings.

THE DRAWINGS

Figure 1:
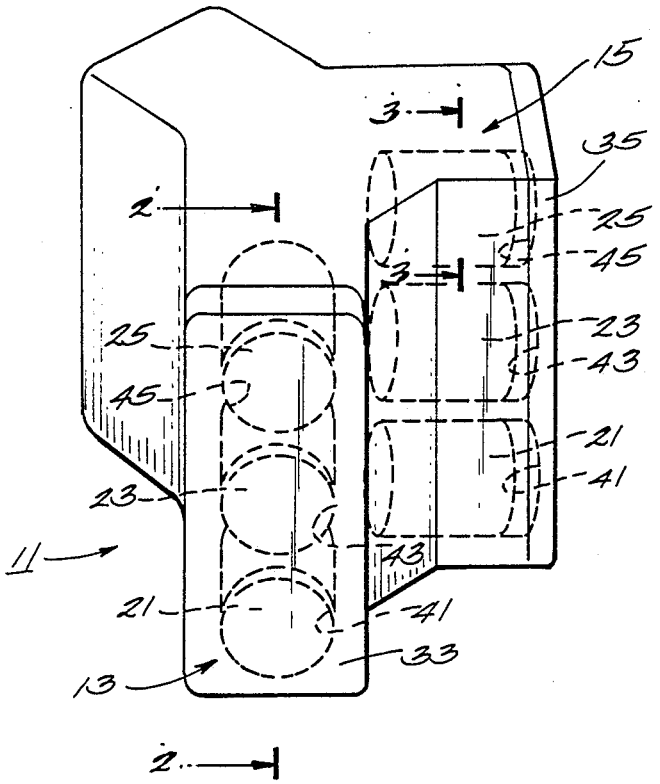
FIG. 1 is a schematic view of a multi cylinder, two stroke internal combustion engine including various of the features of the invention.
Figure 3:
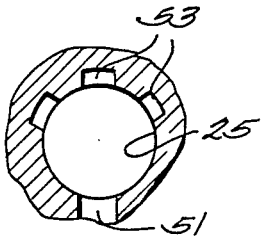
FIG. 3 is a fragmentary schematic view, in section, taken along line 3—3 of FIG. 1.
Figure 2:
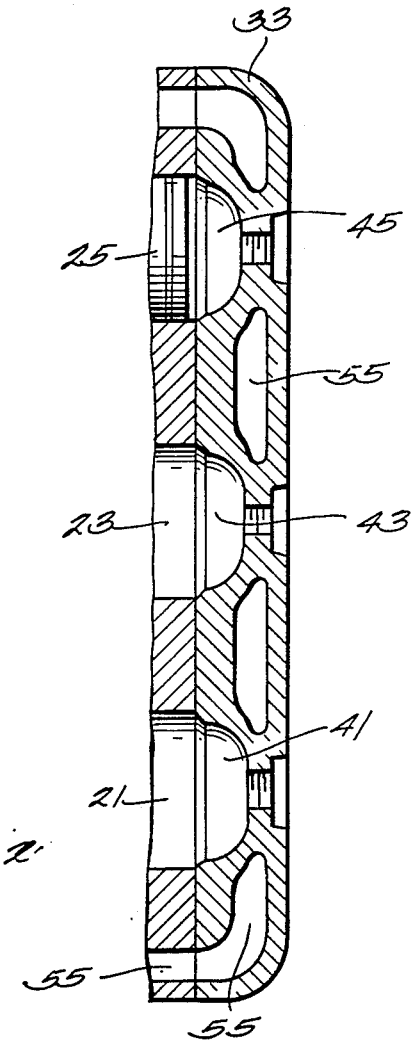
FIG. 2 is an enlarged partial view, in section, taken along line 2—2 of FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is a two stroke multi-cylinder combustion engine 11 including one or more banks of one or more cylinders. Various numbers of cylinder banks can be employed and various numbers of cylinders in each bank can be employed. At a minimum, the invention applies to two banks of one cylinder each, or to one bank of two cylinders each. In addition, the invention is equally applicable to two stroke and four stroke engines. In the disclosed construction, the engine comprises a two stroke V-6 engine 11 including two cylinder banks, 13 and 15 with each of the cylinder banks 13 and 15 including three cylinders 21, 23 and 25.

Associated with each of the cylinders 21, 23, and 25 is a cylinder head. Conventionally, each of the cylinder banks 13 and 15 has respectively fixed thereto individual cylinder heads 33 and 35 having respective cylinder head cavities 41, 43 and 45 of like number to the number of cylinders in the cylinder banks and aligned therewith. Thus, in the disclosed construction, the cylinder banks 13 and 15 each have associated therewith respective cylinder heads 33 and 35, which cylinder heads 33 and 35 each include three cylinder head cavities 41, 43 and 45 respectively aligned and communicating with the three cylinders 31, 33 and 35 in the associated one of the cylinder banks 13 and 15.

Each of the cylinders 21, 23, and 25 has associated therewith a piston (not shown) and an exhaust discharge system including one or more exhaust ports 51. Each of the cylinders 21, 23, and 25 also has associated therewith fuel and air supply systems which can be separate, or can be combined, as in conventional two-stroke carbureted engine practice. Such air and fuel supply systems can includes one or more intake ports 53 and can employ carbureted fuel supply, injected fuel supply, or other fuel supply. In addition, each cylinder has associated therewith at least a portion of a cooling system 55 which, in practice, extends adjacent to the cylinder head cavities 41, 43, and 45 as well as around the cylinders 21, 23, and 25. As a consequence of the foregoing construction, in the past, the individual cylinders of a multi-cylinder internal combustion engine had essentially the same compression ratios but had different sensitivities to knocking.

As indicated above, cylinder knocking is generally determined by temperature and compression ratio, as well as by he amount of spark advance, the type of fuel employed, the quantity fuel supplied, quantity of air supplied, and the efficiency of exhaust discharge and any so called exhaust gas tuning which may be employed. As ignition timing (spark advance) and type of fuel employed are commonly the same for all cylinders of a particular engine, these particular factors can be disregarded. In the Past, while the compression ratios of the cylinders of a particular engine were essentially the same, the sensitivity to knocking of each cylinder varied due to variations in the effectiveness, with respect of each cylinder, of the cooling system and the variations, between cylinders, in the quantity of the air and fuel supplied to each cylinders due to variation in the flow paths in the air and fuel supply systems and due to variations in the exhaust discharge system. In particular, the variations in the exhaust discharge and in the fuel and air supply systems often created, with respect to each cylinder, variations in the resistance to flow within these systems, thereby effecting variation in the quantity of fuel and air supply to each cylinder.

Because of the variations referred to above, when engines with a plurality of cylinders each having essentially the same compression ratios are operated, different cylinders will have differing sensitivities to knocking, i.e., will start to knock at differing engine speeds and loads. In order to avoid engine knocking and, at the same time, to maximize power output, the engine shown in the drawings includes means for providing each of the cylinders with substantially the same sensitivity to knocking, which means comprises pre-selected variation in the size of the cylinder head cavities so as to vary the cylinder compression ratios and thereby to take into account variations in the effectiveness in the cooling system and the variations in the exhaust discharge, the air supply, and the fuel supply systems. Thus, in the construction shown in FIG. 1, each of the cylinder head cavities 41, 43 and 45 is of a different size in order to maximize power output by providing substantially even sensitivity to knocking. As a consequence, because of the difference in cylinder head cavity volumes, the compression ratios of each of the cylinders is purposely different in order to maximize power by providing substantially the same sensitivity to knocking in each cylinder.

Thus, the sizes of the cylinder head cavities 41, 43 and 45 are each designed so as to closely approach a knocking condition at a pre-selected engine operating condition, such as, for example, full speed and load, and at the same time, so as to avoid knocking at the pre-selected engine operating condition. Such maximization of power and avoidance of knocking is obtained by employing compression ratios sufficiently larger than that which, for each cylinder, would result in knocking when operating at wide open throttle.

Because different engines have differing cooling systems, as well as differing exhaust discharge systems, and differing fuel and air supply systems, the individual cylinders thereof have differing sensitivities to knocking. Accordingly the specifics of the sizing of the cylinder head cavities 41, 43 and 45 to provide substantially the same sensitivity to knocking will vary from engine to engine and hence no specific dimensional indication is provided. However, in general, for each cylinder, the size of the cylinder head cavity should be slightly larger than the size at which knocking would normally occur in that particular cylinder when operating with a given fuel and at a given load and speed. Accordingly, as a consequence, cylinder head cavity enlargement provides a somewhat lesser compression ratio. Also as a consequence, the various engine cylinders can have differing compression ratios in order to maximize the uniformity of the sensitivity to knocking.

The means for providing each of the cylinders with substantially the same sensitivity to knocking, i.e., providing each of the cylinders with respectively different compression ratios, can take forms other than variation in the size of the cylinder head cavities as described above. For instance, the diameter of the cylinders can be varied to provide different compression ratios. In addition, the dimensions between the top faces of the pistons and the wrist pins connecting the pistons to the connecting rods can be varied. Still further in addition, the lengths of the connecting rods between the wrist pins and the crankpins can be varied. Still further in addition, the radial distances of the crankpins from the crankshaft axis can be varied.

Still further in addition, the time when the cylinders are closed can be varied. In two-stroke engines, this can be accomplished by variations in the distances between the top edges of the exhaust ports and the cylinder heads. In four-stroke engines, this can be accomplished by changing the shapes of the intake port cams.

Other variations to provide substantially the same sensitivity to knocking can also be employed.

Various of the features of the invention are set forth in the following claims.

We claim:

1. An internal combustion engine comprising first and second cylinders and first and second cylinder head cavities respectively aligned and communicating with said first and second cylinders to define respective compression ratios associated with said first and second cylinders, and means for providing said first and second cylinders with respectively different non-variable compression ratios selected to maximize the power produced in each cylinder without knocking.

2. An internal combustion engine in accordance with claim 1 wherein said means comprises pre-selected difference between the respective sizes of said first and second cylinder head cavities.

3. An internal combustion engine comprising first and second cylinders and first and second cylinder head cavities respectively aligned and communicating with said first and second cylinders to define respective compression ratios associated with said first and second cylinders, and means for providing said first and second cylinders with substantially the same sensitivity to knocking, said means comprising fixed and pre-selected variation in the respective sizes of said first and second cylinder head cavities.

* * * * *